US008573454B2

(12) United States Patent
Talavera Tolentino

(10) Patent No.: US 8,573,454 B2
(45) Date of Patent: Nov. 5, 2013

(54) COMBINATION BACKPACK AND SEATING APPARATUS

(76) Inventor: Rafael Alberto Talavera Tolentino, Chihuahua (MX)

( * ) Notice: Subject to any disclaimer, the term of this patent is extended or adjusted under 35 U.S.C. 154(b) by 371 days.

(21) Appl. No.: 12/886,198

(22) Filed: Sep. 20, 2010

(65) Prior Publication Data

US 2012/0067930 A1 Mar. 22, 2012

(51) Int. Cl.
*A45F 4/02* (2006.01)

(52) U.S. Cl.
USPC ..... 224/155; 224/153; 297/17; 297/129

(58) Field of Classification Search
USPC ..... 224/155, 575, 577, 153, 156; 297/16.1, 297/17, 118, 129
See application file for complete search history.

(56) References Cited

U.S. PATENT DOCUMENTS

| | | | | |
|---|---|---|---|---|
| 1,039,078 | A | 9/1912 | Arnold | |
| 1,452,869 | A | 4/1923 | Cattier | |
| 3,315,856 | A | 4/1967 | Black | |
| 4,286,739 | A | 9/1981 | Silcott et al. | |
| 4,387,924 | A * | 6/1983 | Fernandez | 297/188.01 |
| 4,489,866 | A | 12/1984 | Korte | |
| 4,544,203 | A | 10/1985 | Younger | |
| 5,409,291 | A * | 4/1995 | Lamb et al. | 297/129 |
| 5,536,064 | A | 7/1996 | MacLean | |
| 5,927,798 | A | 7/1999 | Ahn | |
| 6,048,023 | A * | 4/2000 | Lampton | 297/129 |
| 6,145,716 | A | 11/2000 | Caicedo | |
| 6,547,324 | B1 * | 4/2003 | Ammann, Jr. | 297/129 |
| D481,547 | S * | 11/2003 | Ammann, Jr. | D6/335 |
| 6,824,209 | B1 * | 11/2004 | Redzisz et al. | 297/45 |
| 6,986,445 | B1 | 1/2006 | Stockman | |
| RE39,022 | E | 3/2006 | Welsh | |
| 7,118,172 | B1 * | 10/2006 | Pattison-Sheets | 297/129 |
| 7,219,868 | B2 | 5/2007 | Marler et al. | |
| D570,122 | S * | 6/2008 | Wehner | D6/335 |
| 7,604,288 | B1 * | 10/2009 | Verhulst | 297/129 |
| 7,644,981 | B2 * | 1/2010 | Hensley | 297/17 |
| D685,584 | S * | 7/2013 | Ammann, Jr. | D6/336 |
| 2004/0056517 | A1 | 3/2004 | Farber et al. | |
| 2006/0261103 | A1 | 11/2006 | Strange | |
| 2007/0012734 | A1 | 1/2007 | Lee et al. | |
| 2008/0179358 | A1 | 7/2008 | Redzisz et al. | |
| 2009/0079244 | A1 | 3/2009 | Kelleher | |
| 2009/0256401 | A1 | 10/2009 | Hensley | |

* cited by examiner

*Primary Examiner* — Justin Larson
*Assistant Examiner* — Corey Skurdal

(57) ABSTRACT

A combination backpack and seating apparatus. The present invention comprises a seat member having a top wall, at least one side wall, a front wall, and a rear wall defining a seat volume. A back support is rotatably connected proximal to the rear wall of the member and is rotatable between an angled position that is inclined relative to the sitting surface and a horizontal position substantially adjacent to the sitting surface. The invention comprises a foldable support assembly that is configurable to a generally planar folded state and an expanded state, wherein in the folded state the support assembly is rotatable between a first position that is generally parallel to the sitting surface. The invention further comprises an enclosure detachably connected to the back support.

17 Claims, 21 Drawing Sheets

20
36
38
40
42
44
45
45
46
47
48
21
21
23
24
25
25
26
27
28
28
31
32
34
34
50
50
50
51
51
52
53
53s
53s
53s
53e
53e
54
54
55
56
59
61

144
120
146
124
122
136
125
176
180
160
131
175
177
174
179
130
166
158
178
180
177
176
175
131
136
138
160
166
170
162
158
155
168
166
164
158
156
152
154

COMBINATION BACKPACK AND SEATING APPARATUS

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates to a combination backpack and seating apparatus. More specifically, the invention is an apparatus that is convertible into multiple configurations including a stool, a bleacher seat, a legless chair, and a backpack.

2. Description of the Related Art

Configurable seating apparatuses are well known, but are limited in utility. For example, such seating apparatuses may be configurable into a chair and a transportable bag, such as shown in U.S. Pat. No. 1,039,078. U.S. Pat. No. 1,452,869 describes a portable apparatus in which a portion can be folded underneath the seat portion of the chair to form a four-legged seat. U.S. Pat. No. 3,315,856 discloses a combination packboard and folding stool. U.S. Pat. No. 4,286,739 discloses a backpack that is convertible into a chair and/or cot.

The above-referenced inventions, however, do not disclose a seating apparatus capable of being configurable between a chair configuration, a stool configuration, a backpack (or carryon) configuration, a legless chair configuration, and a bleacher seat configuration. Accordingly, there is a need for such a device to increase a user's ability to address each of these needs with a single apparatus to obviate the need to travel with excessive equipment.

BRIEF SUMMARY OF THE INVENTION

The present invention is a combination backpack and seating apparatus. The present invention comprises a seat member having a top wall, at least one side wall, a front wall, and a rear wall defining a seat volume. A back support is rotatably connected proximal to the rear wall of the member and is rotatable between an angled position that is inclined relative to the sitting surface and a horizontal position substantially adjacent to the sitting surface. The invention comprises a foldable support assembly that is configurable to a generally planar folded state and an expanded state, wherein in the folded state the support assembly is rotatable to a first support position that is generally parallel to the sitting surface. The invention further comprises an enclosure detachably connected to the back support. The present invention may be used, inter alia, in amusement park settings, sporting events, outdoor excursions, and/or military and combat settings as part of a soldiers' equipment.

DETAILED DESCRIPTION OF THE INVENTION

Figure 1:
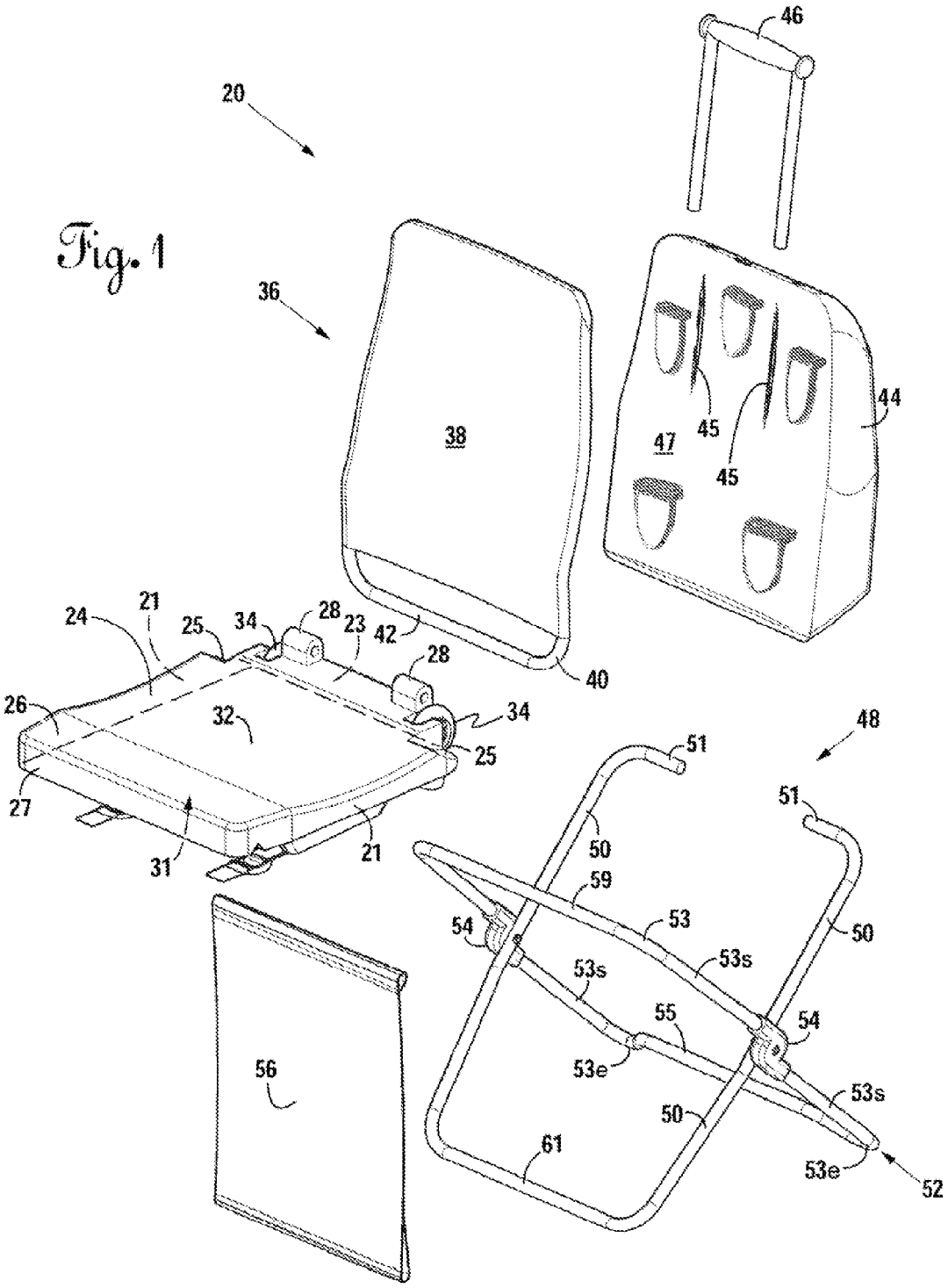
FIG. 1 is an exploded front isometric view of the various assemblies of an embodiment of the present invention.
Figure 2:
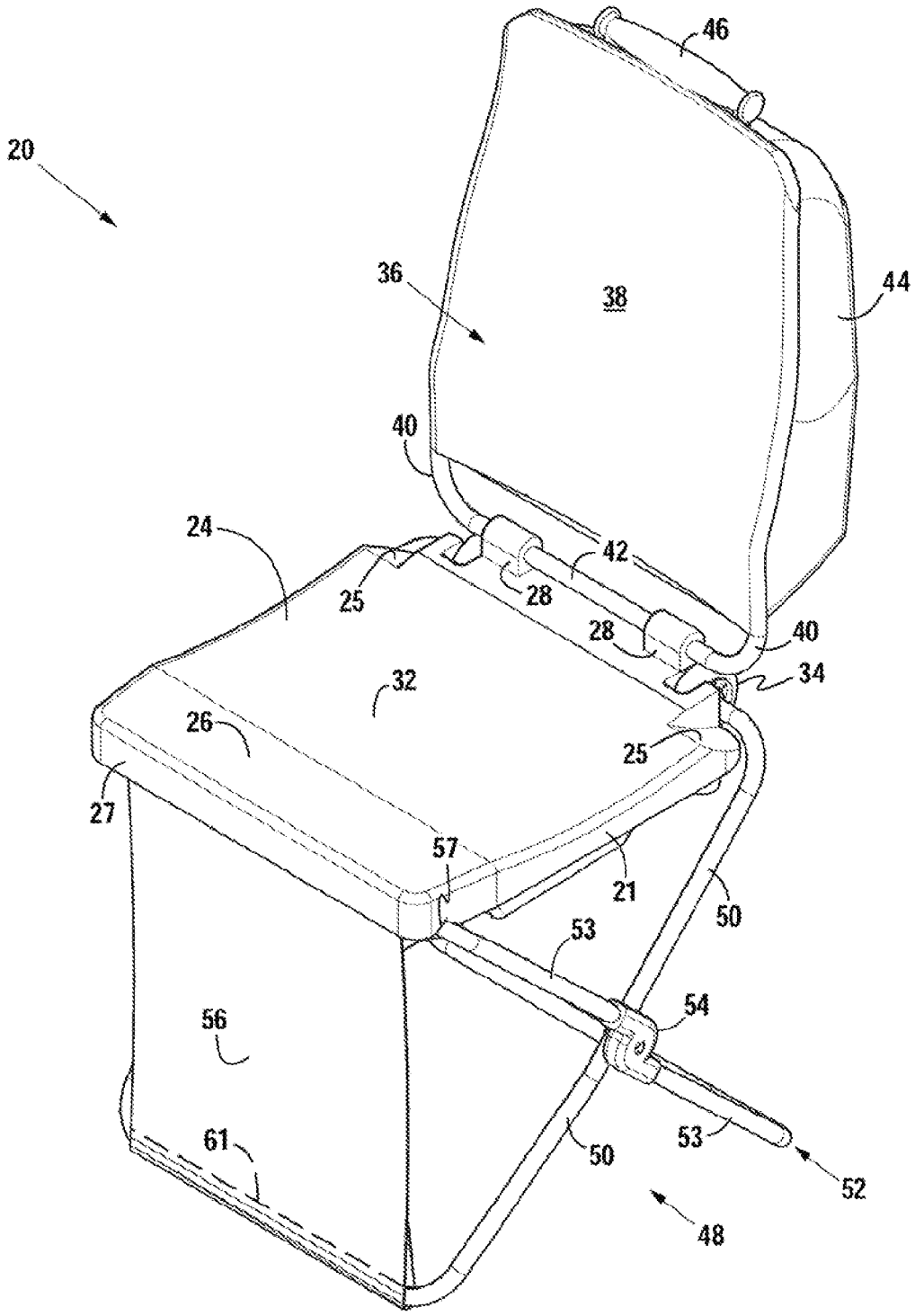
FIG. 2 is a front isometric view of an embodiment of the present invention in a chair configuration.
Figure 3:
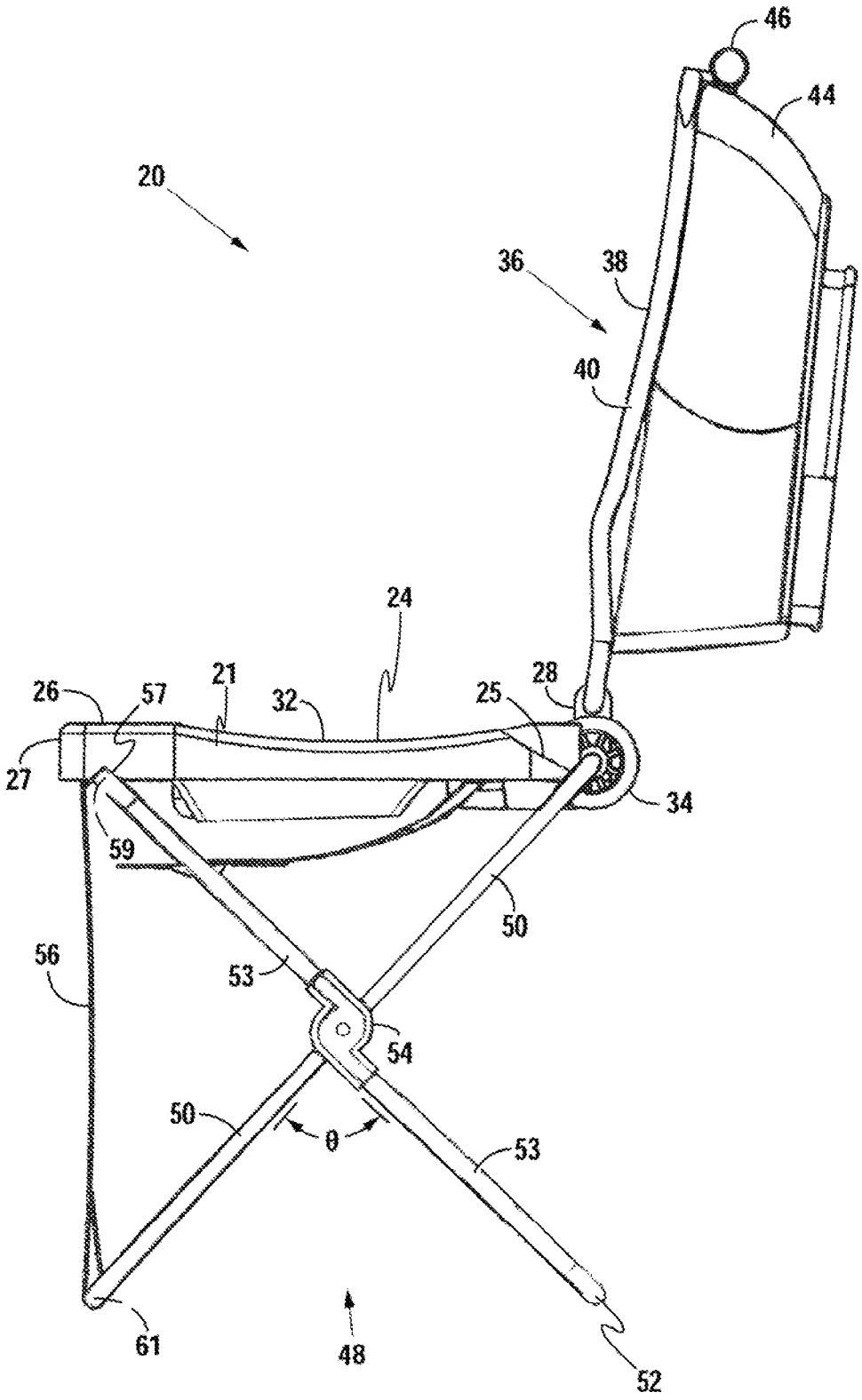
FIG. 3 is a side elevation of an embodiment in the chair configuration shown in FIG. 2.

FIG. 1 is an isometric view of the various assemblies of one embodiment 20 of the present invention. FIG. 2 and FIG. 3 are an isometric view and side elevation, respectively, of the embodiment 20 in a chair configuration. The embodiment 20 comprises a seat member 24 having a generally square top wall 26, side walls 21, a rear wall 23, and a front wall 27. Two aligned block bearings 28 are positioned near the intersection of the top wall 26 and the rear wall 23. The top wall 26 is generally planar, but has a portion 32 that is contoured to increase comfort to the user of the embodiment 20. Rollers 34 are mounted adjacent to the block bearings 28. The rear corners 25 of the top wall 26 are angled downwardly.

A back support 36 comprises a panel 38 of material (e.g., plastic, netting, fabric, or the like) attached to a frame 40. When assembled, a bottom cross member 42 of the frame 40 is positioned within the block bearings 28 to establish a rotatable connection relative to the seat member 24. A selectively openable enclosure 44 having an attachment surface 47 is detachably connectable to the back support 36, as will be described in greater detail hereinafter. An extendable handle 46 is connectable to the interior of the enclosure 44 through slits 45 formed in the attachment surface 47. The handle 46 is extendable between a first handle position where the handle 46 is substantially within the volume of the enclosure 44, as shown in FIG. 2, and a second handle position where the handle 46 is extended from and substantially outside the volume of the enclosure.

The embodiment 20 further comprises a foldable support assembly 48 that includes an inner support member 50 and an outer support subassembly 52. The inner support member 50 is generally U-shaped and has inwardly-turned opposing ends 51 rotationally connected to the seat member 24. The outer support subassembly 52 includes two generally U-shaped outer support members 53 connected with Z-shaped fittings 54. The outer support subassembly 52 is pivotally fastened to the inner support member 50 at the Z-shaped fittings 54 such that the support assembly 48 may be moved between an expanded state, as shown in FIGS. 1-3, and a folded state, as will subsequently be shown and described.

A rear cross member 55 is offset from the ends 53*e* of side members 53*s* of the inner support member 50, such that the rear cross member 55 is elevated relative to the ground surface when the support assembly 48 is in the expanded state and supporting the remainder of the embodiment 20 in a chair configuration. The inner support member 50 and outer support members 53 are made of strong and lightweight material, such as aluminum, but alternatively may be made of steel or other material of sufficient strength to support the weight of the remainder of the embodiment 20 and user.

A stool seat 56 is connected to the front cross members 61, 59 of the inner support member 50 and outer support subassembly 52, respectively. The stool seat 56 is made out of a sturdy canvas to provide both strength and flexibility. A lower end of the stool seat 56 may be selectively unfastened (e.g., with buttons) from the front cross member 61 of the inner support member 50 for storage in other configurations of the embodiment 20.

In the chair configuration shown in FIGS. 2-3, the back support 36 is shown in an angled first position that is approximately normal to the top wall 26. The enclosure 44 is attached to the rear of the back support 36. The support assembly 48 is in an expanded state such that the inner support member 50 and outer support subassembly 52 are angled at approximately a right angle Θ to one another, causing the stool seat 56 to stretch into a substantially planar, vertically-orientated surface. The front cross member 59 of the outer support subassembly 52 is positioned in a triangular groove 57 formed in the bottom of the seat member 24 between the sides 21.

Figure 4A:
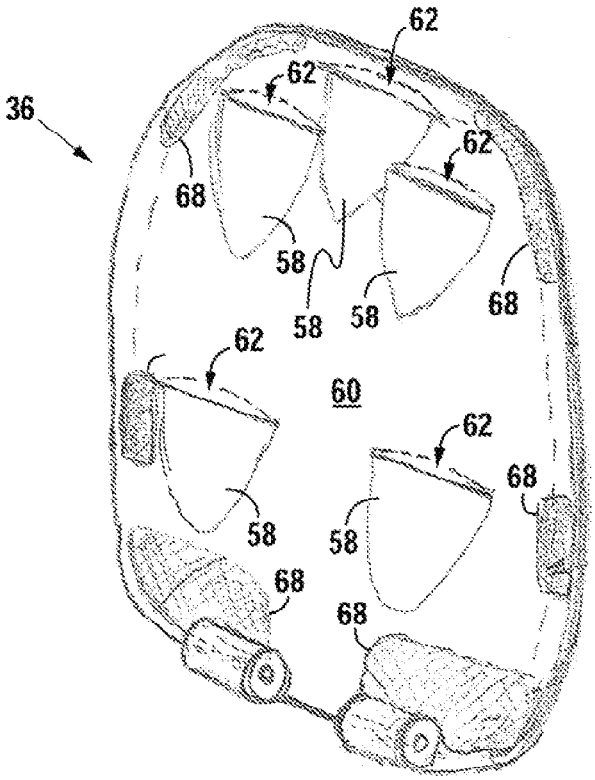
FIG. 4A and FIG. 4B depict the detachable connection of the enclosure to the back support.
Figure 4B:
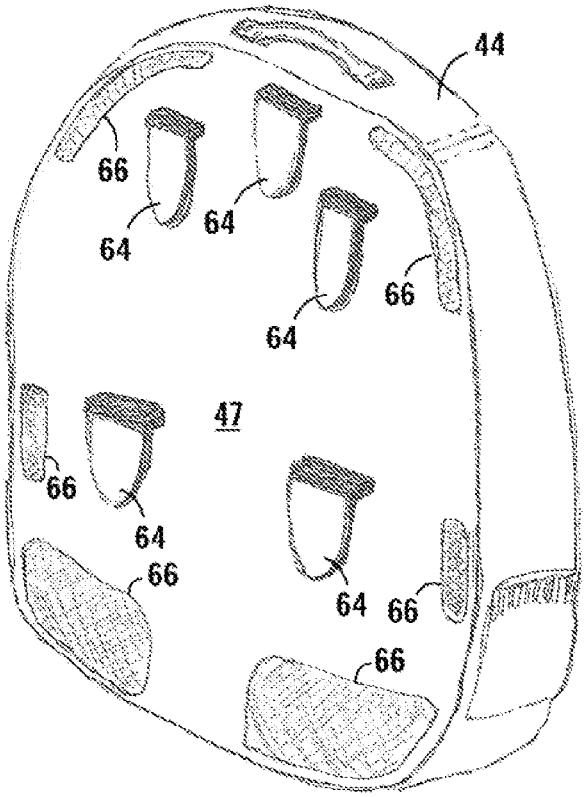

FIGS. 4A & 4B disclose the detachable connection of the enclosure 44 of the embodiment 20 to the back support 36. As shown in FIG. 4A, a plurality of curved plates 58 protrude outwardly from the rear surface 60 of the back support 36 to form generally-triangularly-shaped, upwardly-opening clefts 62. As shown in FIG. 4B, a corresponding number of rigid tabs 64, each shaped and sized to fit snugly into one of the clefts 62, are spaced away from the rear surface 47 of the enclosure 44 and orientated downwardly. The enclosure 44 may be attached to the back support 36 by positioning the tabs 64 over the corresponding clefts 62 and lowering the tabs 64 thereinto. Thereafter, gravitation force holds the tabs 64 within the clefts 62, and the snug fit of the tabs 64 within the clefts 64 inhibit rotation and lateral shifting of the enclosure 44 relative to the back support 36.

To detach the enclosure 44, the enclosure 44 may be lifted relative to the back support 36 to remove the tabs 64 from the clefts 62. The tabs 64 may be steel or plastic, or any other material sufficiently strong to support the weight of the enclosure 44 and its anticipated contents. Additional detachable fastening is provided by corresponding pieces of hook 66 and loop 68 adhered to the enclosure 44 and the back support 36, respectively.

Figure 5:
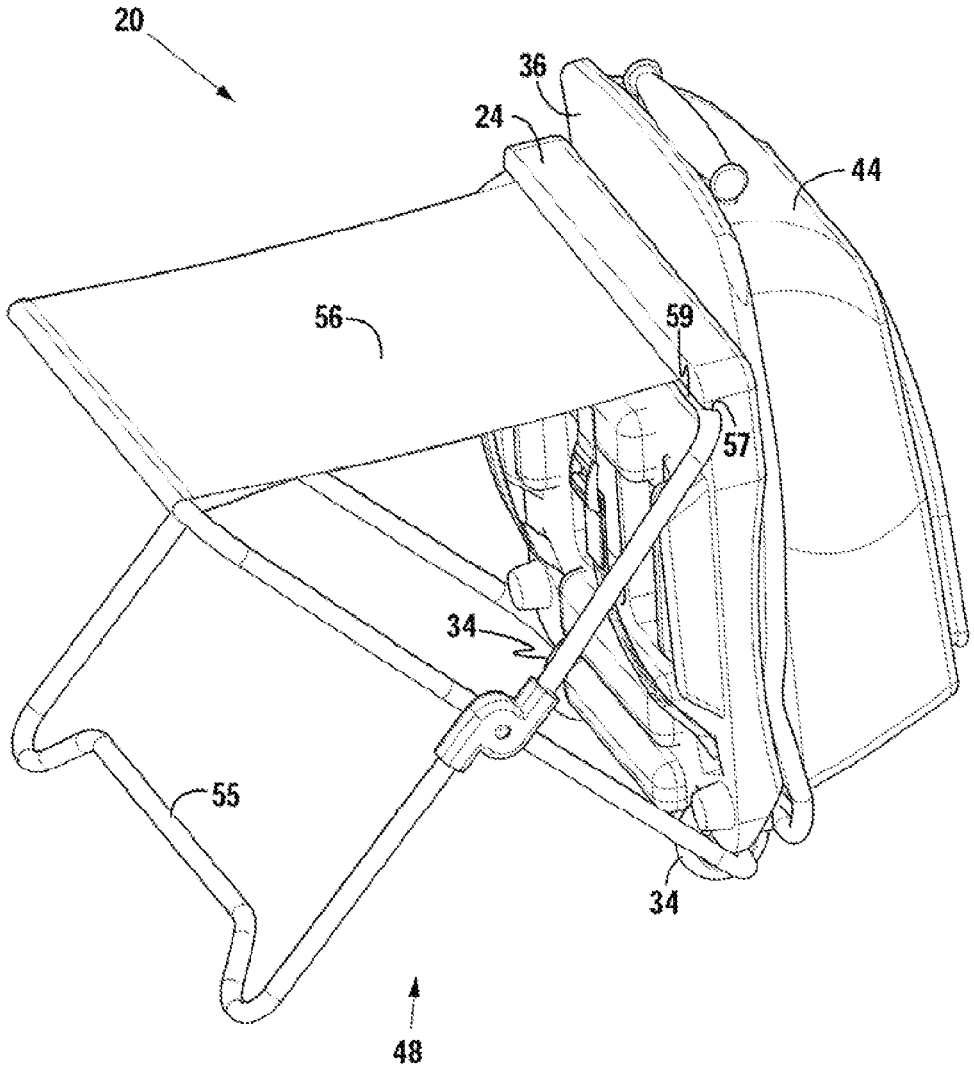
FIG. 5 is a top view of an embodiment in a stool configuration.

FIG. 5 shows the embodiment 20 in a stool configuration with the back support 36 rotated to a second position adjacent to and in contact with the seat member 24. Preferably the back support 36 is contoured to the shape of the top wall 26 to minimize, or altogether eliminate space therebetween, thus minimizing the volume of the embodiment 20 in this configuration. Relative to the chair configuration shown in FIGS. 2-3, the embodiment 20 is rotated backward ninety degrees such that the rollers 34 are in contact with the ground. The support assembly 48 remains in an expanded state, causing the stool seat 56 to be stretched into a surface for supporting a person. The front cross member 59 is positioned in the triangularly-profiled groove 57 extending across the width of the seat member 24.

Figure 5A:
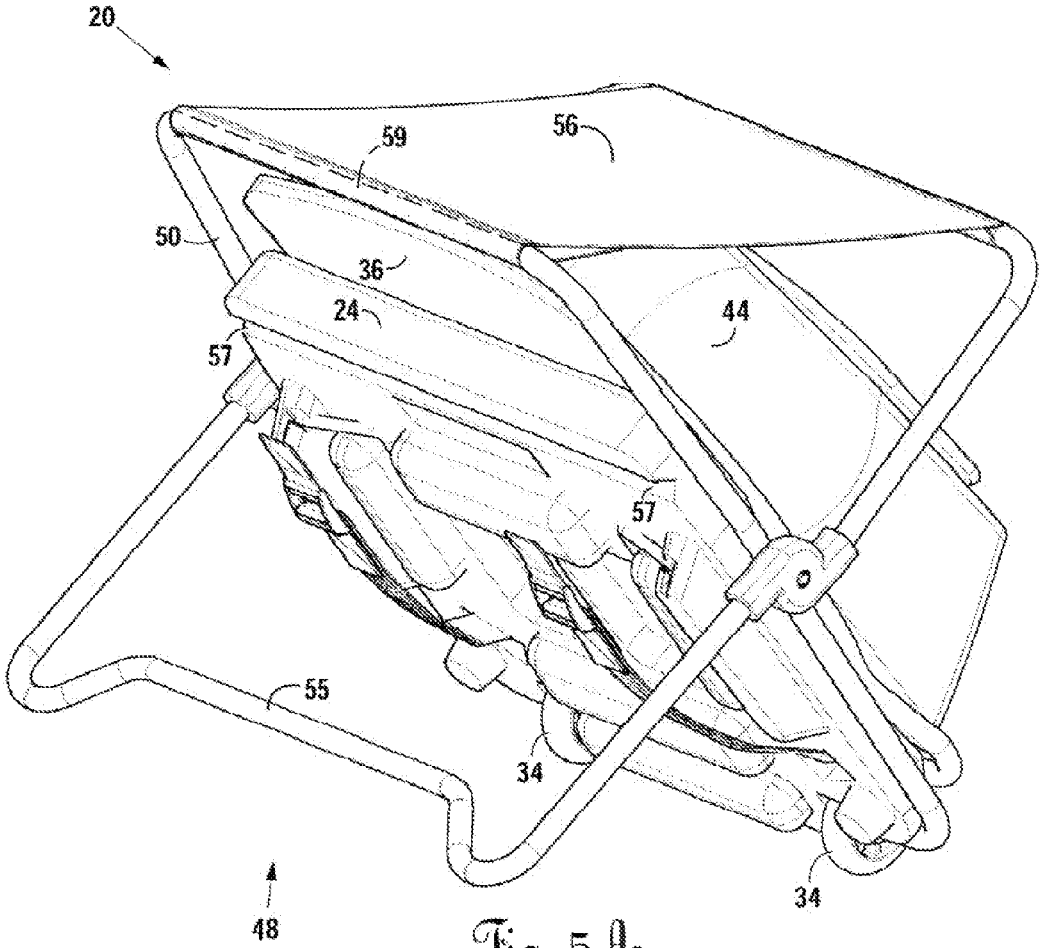
FIG. 5A is a front perspective view of the embodiment in a stool configuration.
Figure 5B:
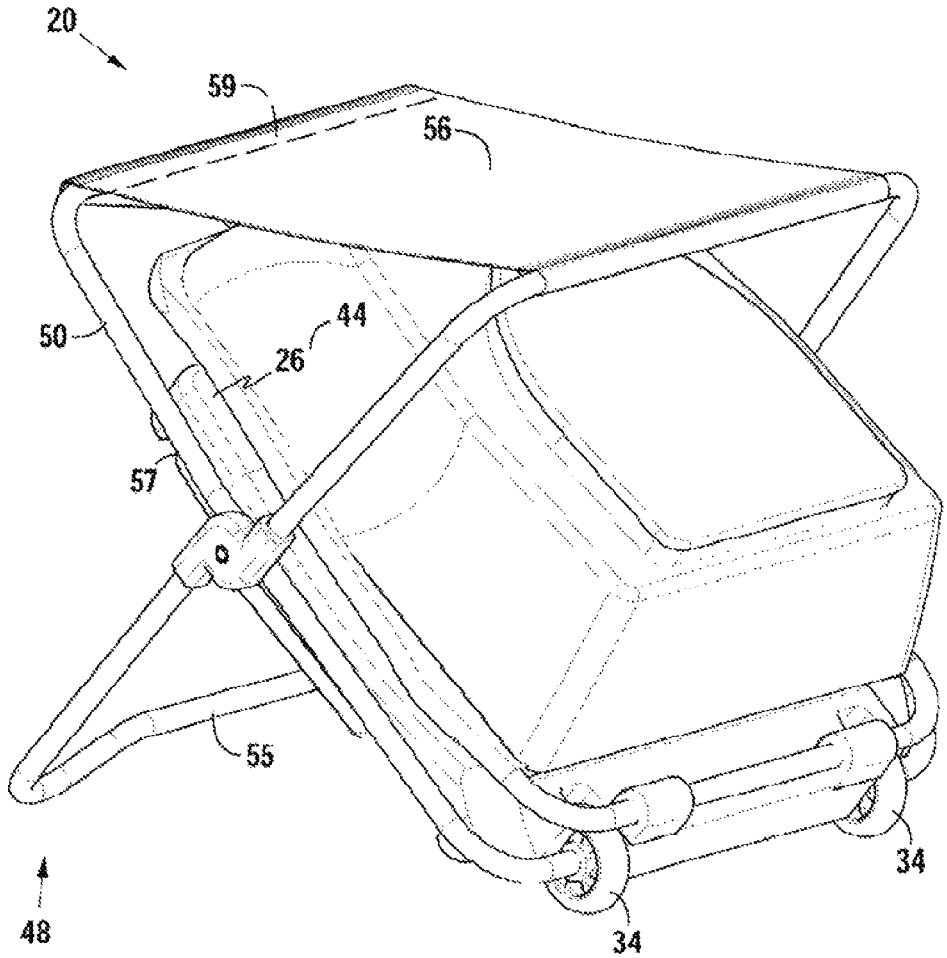
FIG. 5B is a rear perspective view of the embodiment in the stool configuration of FIG. 5A.

FIGS. 5A-5B show the embodiment 20 in a different stool configuration from that shown in FIG. 5, and with the seat member 24 orientated substantially parallel to the inner support member 50 and positioned below the stool seat. The embodiment 20 may be positioned in this configuration by removing the front cross member 59 from the groove 57, moving the support assembly 48 to a generally planar folded state aligned with the seat member 24, moving the back support 36 to the second back support position adjacent the top wall of the seat member 24, and then expanding the support assembly 48 to a supporting position. In this configuration, the enclosure 44 is positioned below the stool seat with the back support 36 adjacent to the seat member 24.

Figure 6:
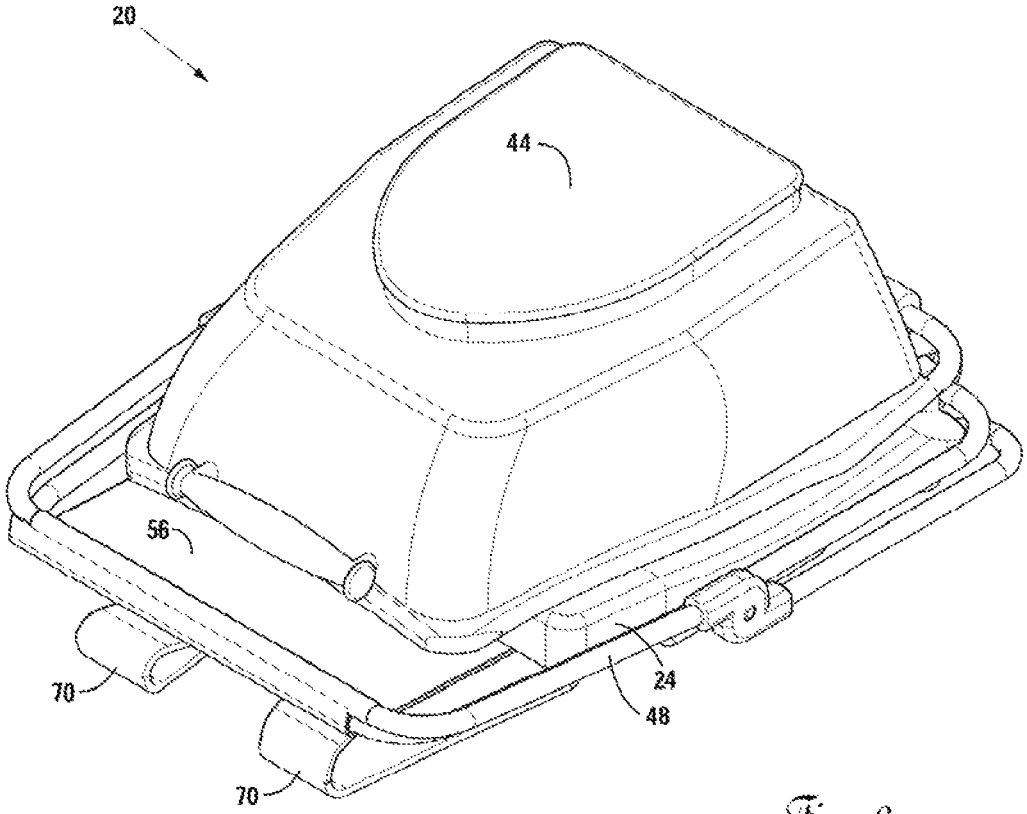
FIG. 6 is a top isometric view of an embodiment in the backpack configuration shown in FIG. 5.
Figure 7:
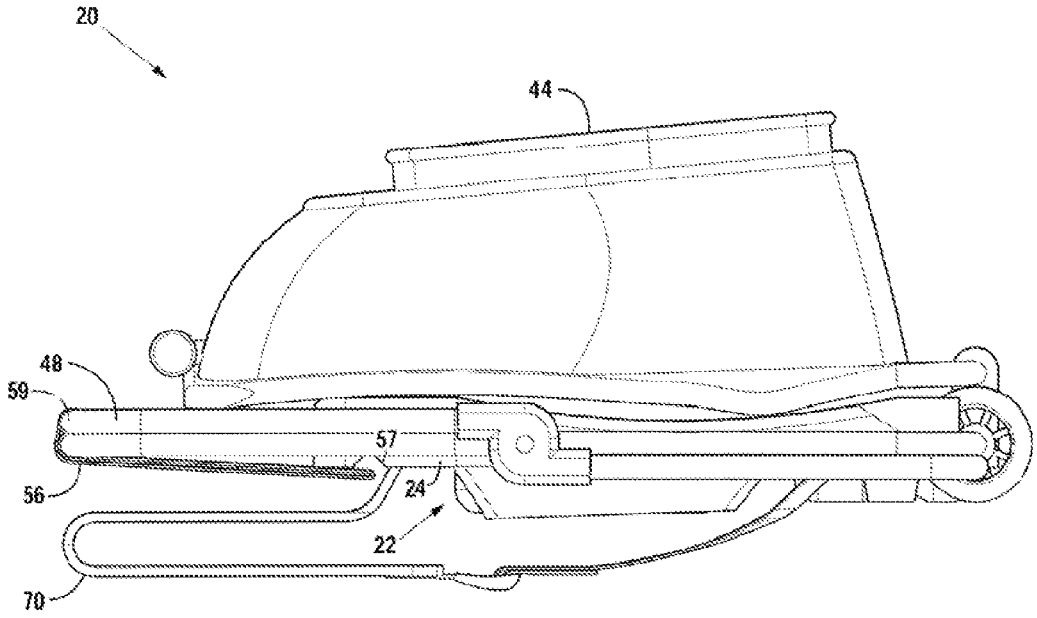
FIG. 7 is a side elevation of an embodiment in the backpack configuration shown in FIG. 6.

FIGS. 6-7 show the embodiment 20 in a backpack configuration, which is attainable from the stool configuration shown in FIG. 5 by folding the support assembly 48 to a folded state and rotating it to a first support position that is substantially parallel with the top wall 26. To accomplish this, the front cross member 59 of the outer support subassembly 52 must be removed from the triangular groove 57. The stool seat 56 is positioned against and fastened to the bottom of the seat member 24 using hook and loop. Two adjustable carrying straps 70 are fastened to the bottom of the seat member 24.

Figure 8:
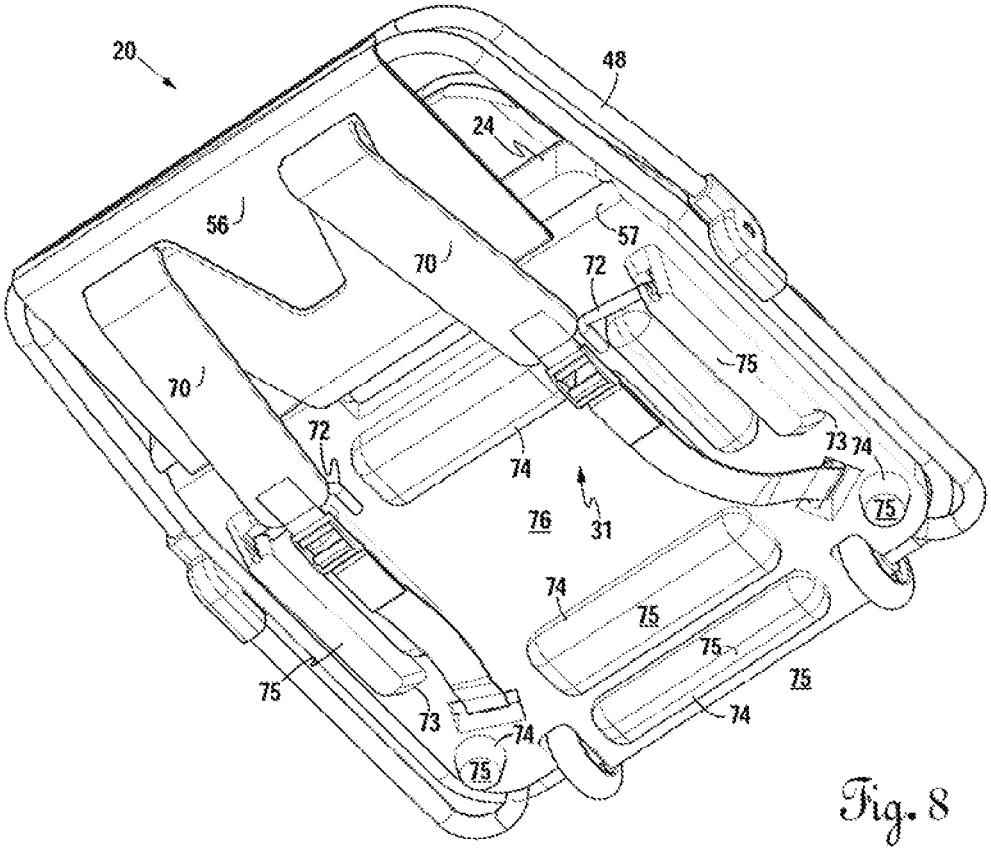
FIG. 8 is a bottom perspective view of an embodiment in the backpack configuration shown in FIGS. 6-7.

FIG. 8 is a bottom isometric view of the embodiment 20 in the backpack configuration shown in FIGS. 6-7. Load-bearing members 73, 74 are positioned on the bottom surface 76 of the seat member 24. The load-bearing members 73, 74 help support and distribute the weight of the embodiment 20 and user when used on a flat surface such as a floor or sidewalk.

Opposing hook members 72 are moveably connected to two of the elongated load-bearing members 73. The hook members 72 are rotated inward and upward to be adjacent to the bottom surface 76 of the seat member 24. The support assembly 48 is in a folded state and rotated to a first position substantially parallel to the seat member 24. The stool seat 56 is folded underneath the support assembly 48 and attached to the bottom surface of the seat member.

Figure 9:
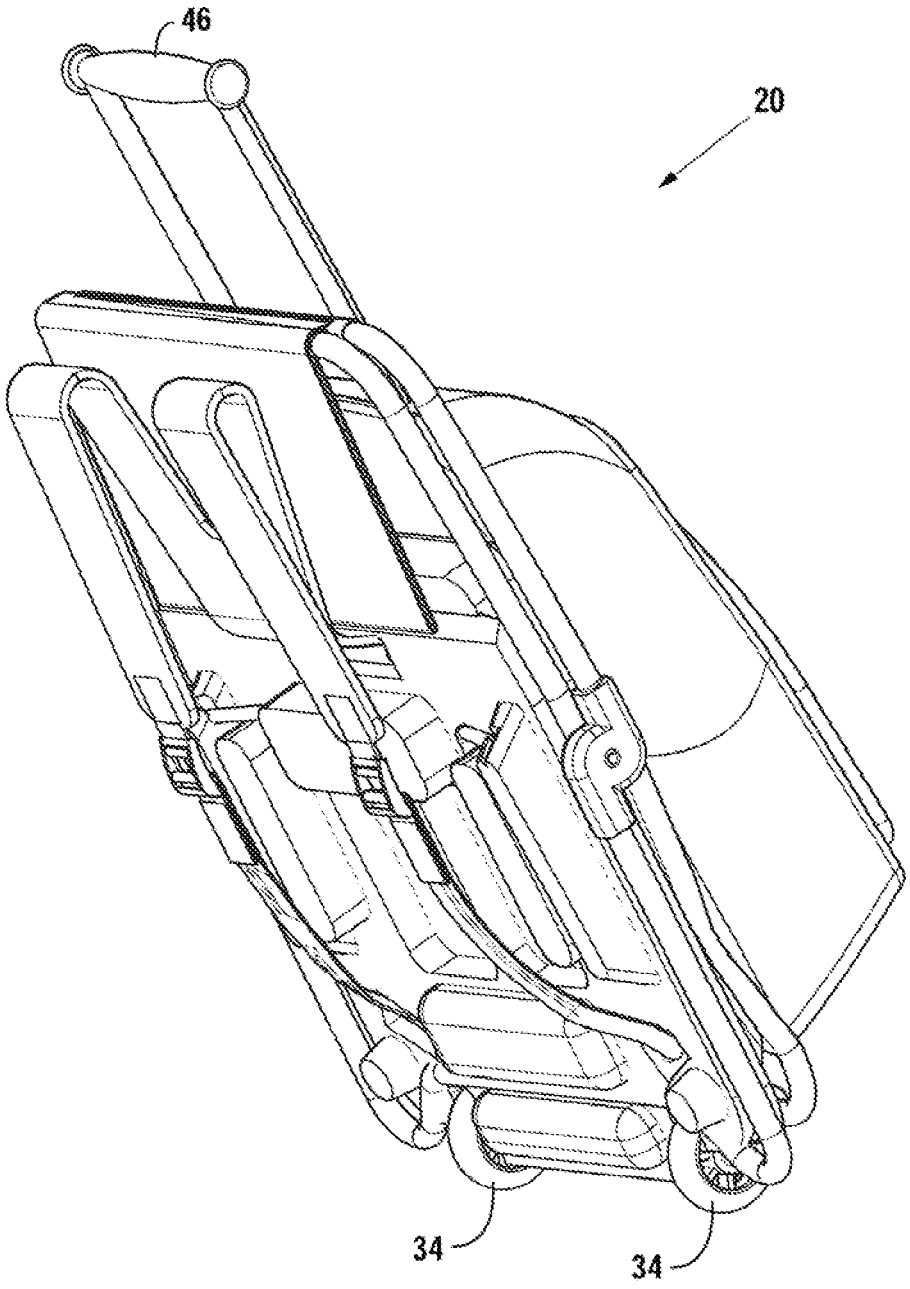
FIG. 9 is an isometric view of an embodiment shown in FIGS. 5-8 in a backpack configuration with the handle extended from the enclosure.

FIG. 9 shows the embodiment depicted in FIGS. 6-8 with the handle 46 in a second handle position extended from the enclosure in a towable configuration. The rollers 34 contact a ground surface so that the embodiment 20 may be towed behind the user for ease of transport.

Figure 10:
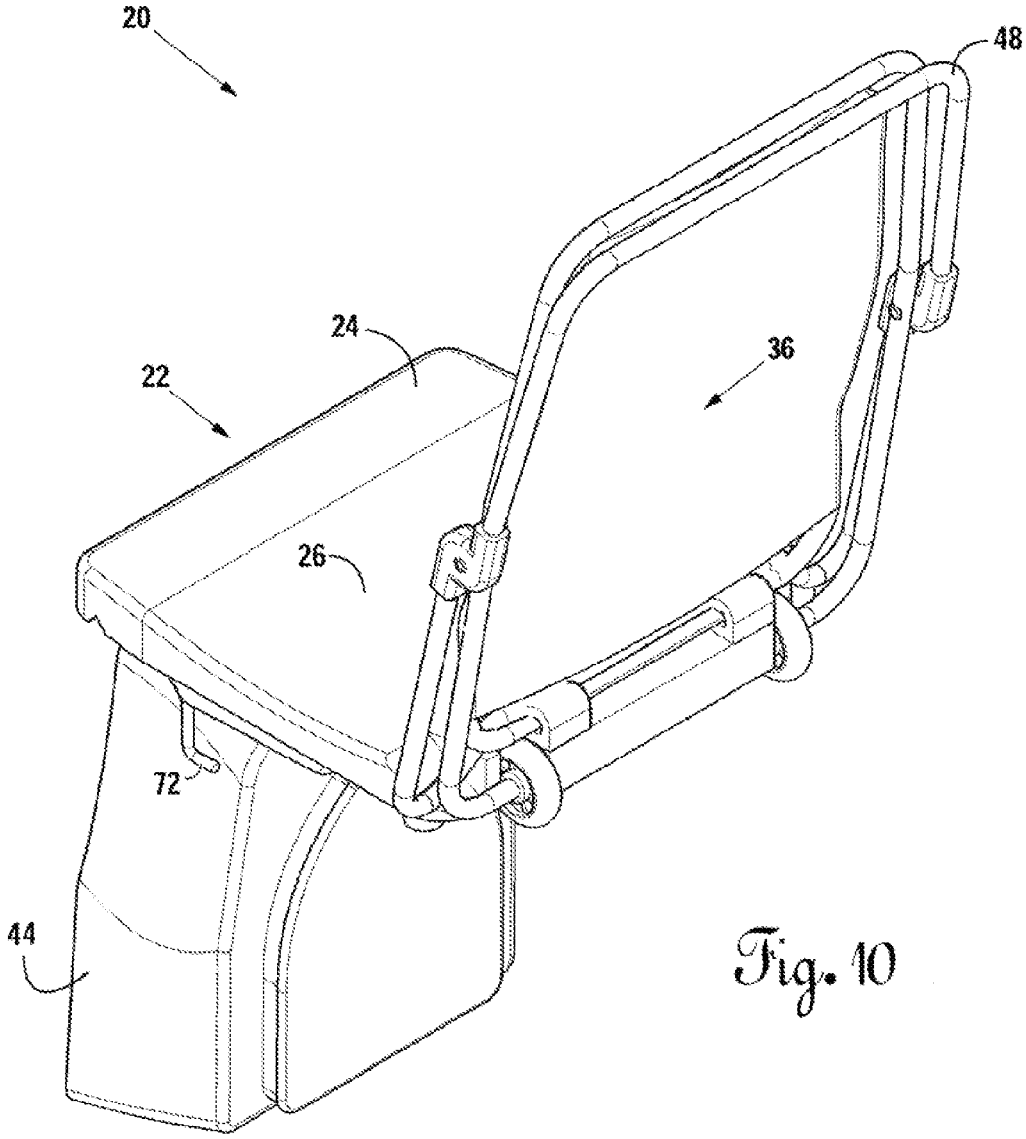
FIG. 10 is a rear isometric view of an embodiment in a bleacher seat configuration.
Figure 11:
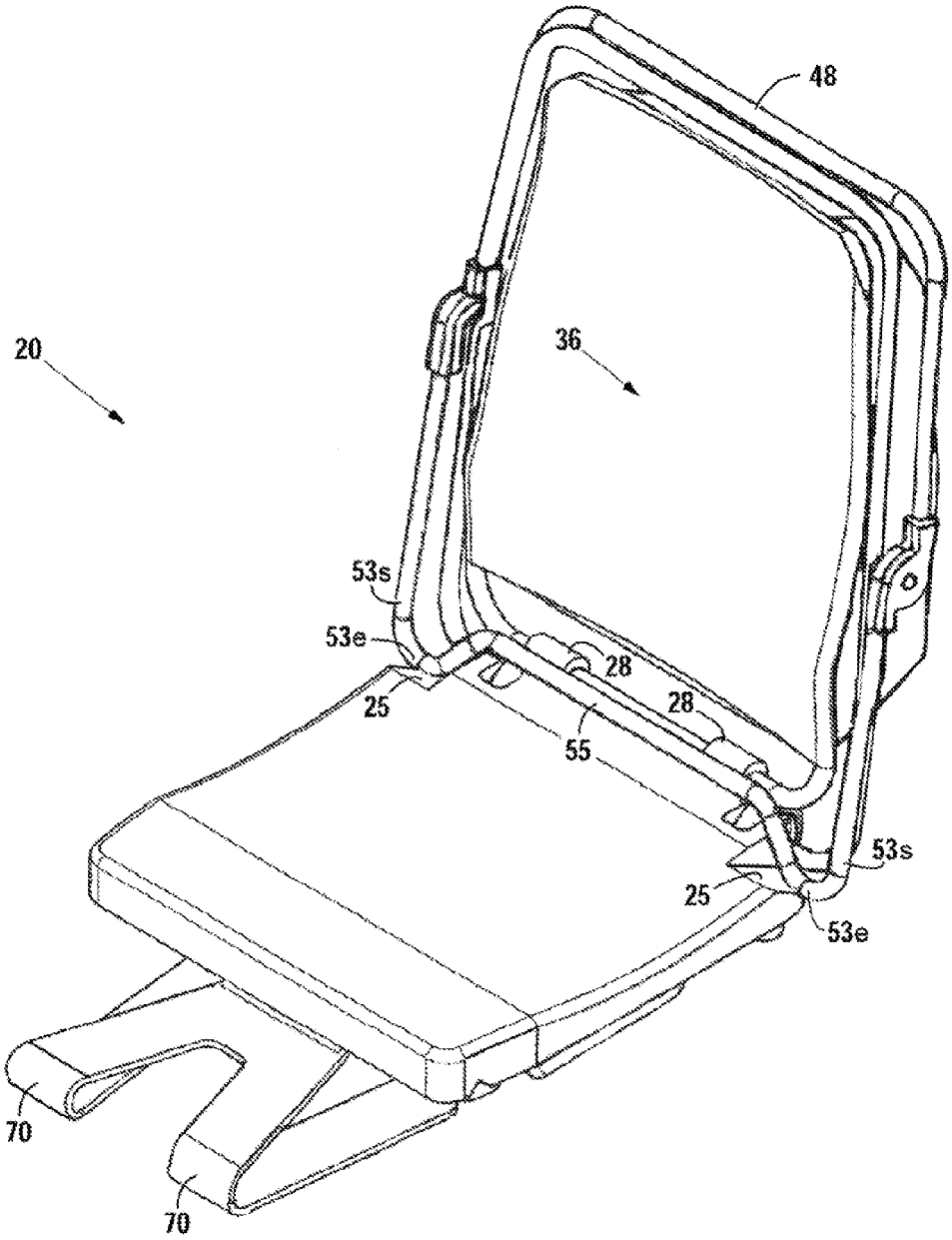
FIG. 11 is a front isometric view of an embodiment in an alternative bleacher seat configuration or legless chair configuration.

FIG. 10 and FIG. 11 are a rear isometric and front isometric view, respectively, showing the embodiment 20 in a bleacher seat configuration. The back support 36 is in substantially the same position as shown in FIG. 1—that is, inclined relative to the top wall 26 of the seat member 24. The support assembly 48 is in a generally-planar folded state and rotated to a second support position that is generally parallel to the back support 36. The moveable hook members 72 extend downwardly from the bottom of the seat member 24 for securing to the front of a bleacher seat. As shown in FIG. 10, the enclosure 44 may optionally be suspended from the seat member 24 to increase foot and leg space behind the back support 36. As shown in FIG. 11, when in the bleacher seat configuration, the rear cross member 55 of the support assembly 48 is positioned forward of the block bearings 28, and the ends 53*e* of the side members 53*s* are proximal to the profiles 25 formed in the seat member 24.

Figure 12:
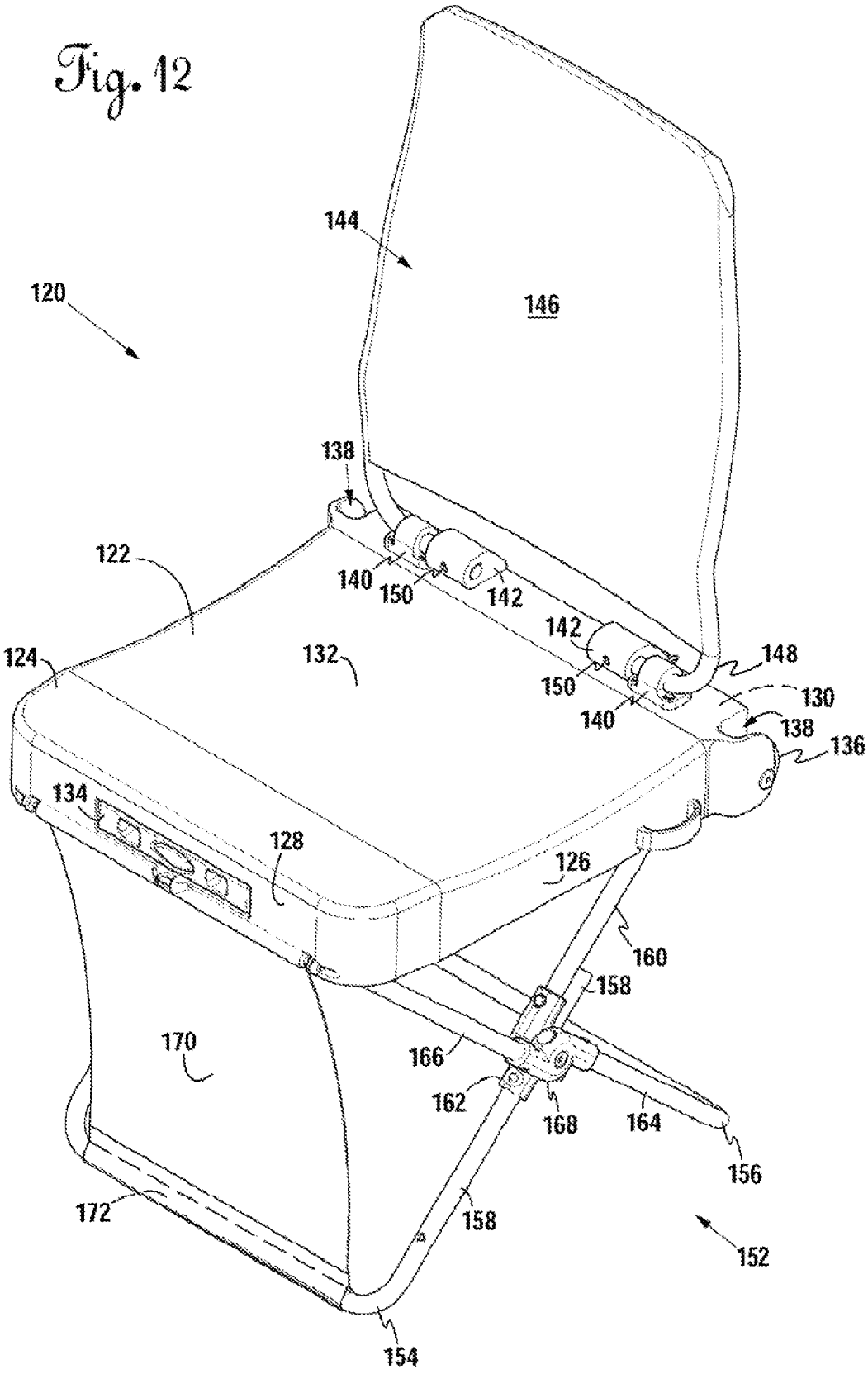
FIG. 12 is a front, top isometric view of a second embodiment of the invention in the chair configuration.
Figure 13:
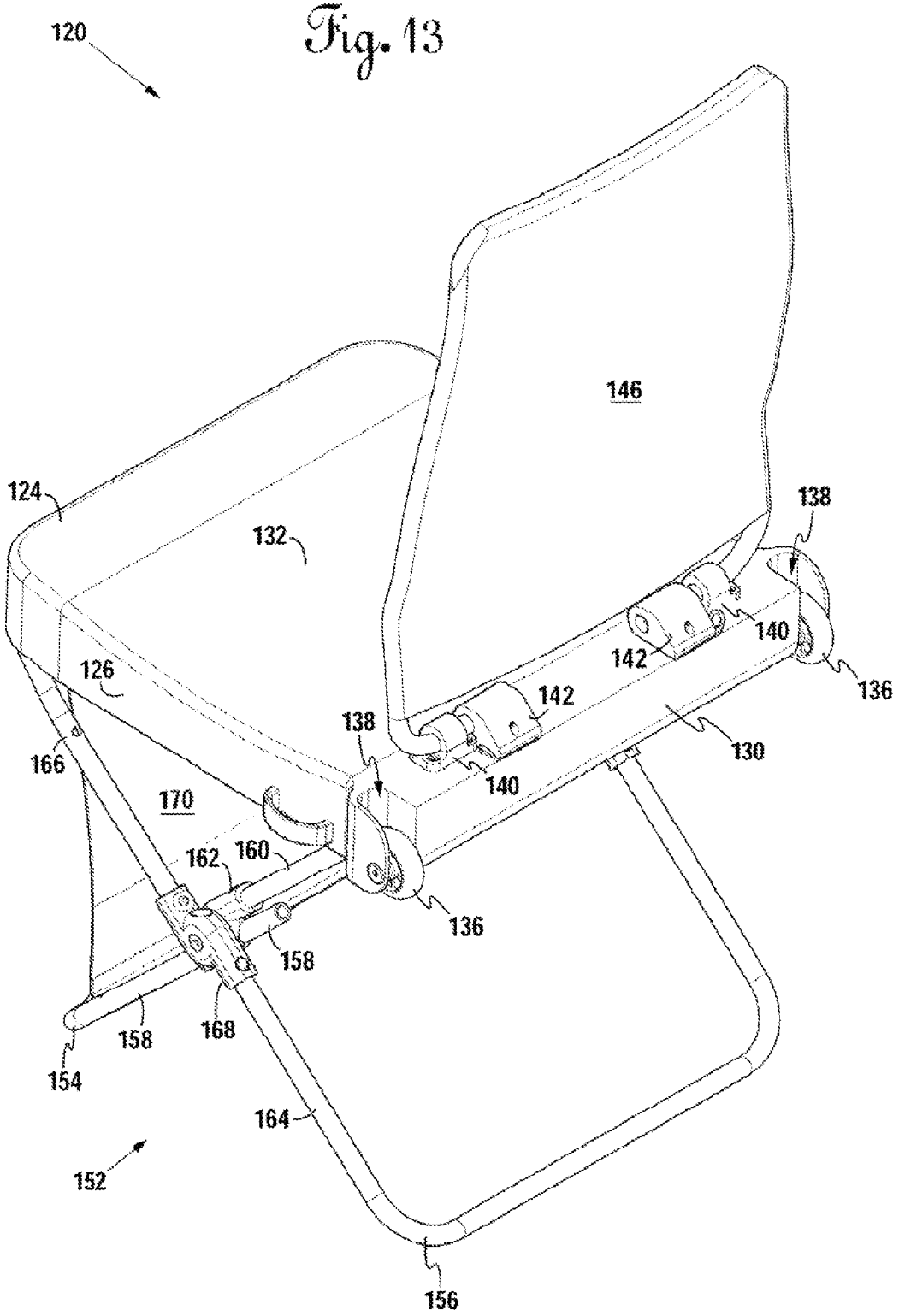
FIG. 13 is a rear, top isometric view of the second embodiment in the chair configuration.
Figure 14:
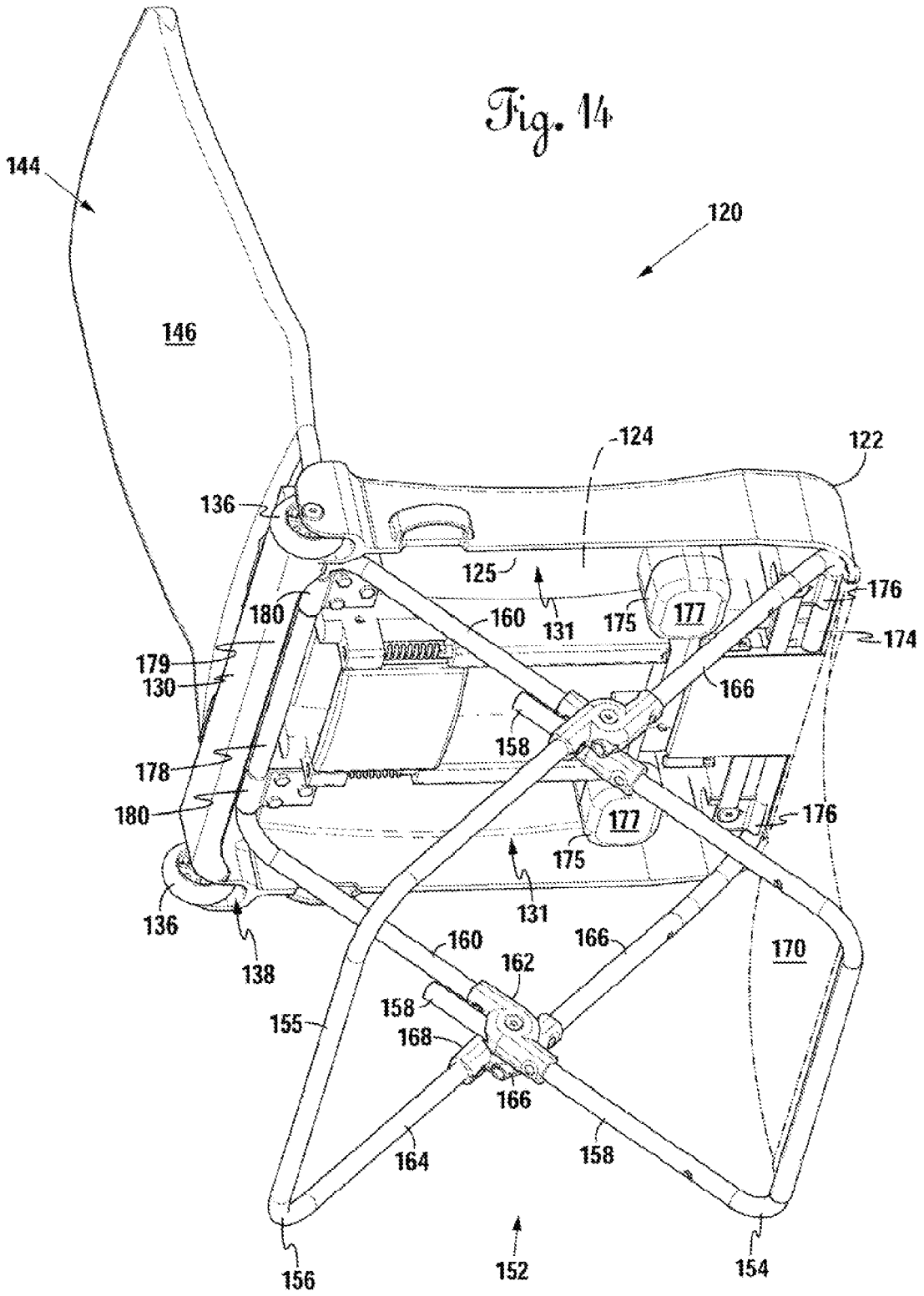
FIG. 14 is a bottom isometric view of the second embodiment in the chair configuration.

FIG. 12-14 are front, rear, and bottom isometric views, respectively, of an alternative embodiment 120 of the present invention in a chair configuration. The embodiment 120 provides for detachment of the backpack from the seating apparatus so that the backpack and seating apparatus can be used independently.

This embodiment 120 comprises a seat member 122 with a generally-square top wall 124, side walls 126, a front wall 128, and a rear wall 130. The top wall 124 is generally planar, but has a concave portion 132 to increase comfort to the user when seated on the embodiment 120. A handle 134 is extendable through the front wall 128 between a first handle position wherein the handle is substantially within the seat volume, as shown in FIG. 12, and a second handle position where the handle is extended from the seat volume 131 through the front wall 128. Rollers 136 are located within channels 138 formed at opposing ends of the rear wall 130. The top wall 124, side walls 126, front wall 128, and rear wall 130 define an open seat volume 131.

Two longitudinally-aligned outer block bearings 140 are fastened to the seat member 122 proximal to the intersection of the top wall 124 and the rear wall 130. Two inner block bearings 142 are aligned with the outer block bearings 138 and fastened to the seat member 124.

A back support 144 is rotatably attached to the seat member 122. The back support 144 comprises a panel 146 of material (e.g., fabric, netting, plastic, or other suitable material) attached to a frame 148. The frame 148 is positioned within the outer block bearings 140 and the ends of the frame 148 are positioned in the inner block bearings 142, to establish the rotatable connection of the back support 144 relative to the seat member 124. Screws 150 extend through the inner block bearings 142 to engage the ends of the frame 148.

The seat member 122 is supported by a foldable support assembly 152 that includes an inner subassembly 154 rotatably connected to an outer subassembly 156. The inner subassembly 154 has two generally U-shaped inner support members 158, 160 connected at their ends with Z-shaped fittings 162. The outer subassembly 156 has two generally U-shaped outer support members 164, 166 connected at their ends with Z-shaped fittings 168. The Z-shaped fittings 162, 168 are identically shaped and connected to allow rotation of the inner subassembly 154 relative to the outer subassembly 156, which allows the support assembly 152 to be moved between an expanded state, as shown in FIG. 12, and a folded state, as will be shown and described infra. The inner support members 158, 160 and outer support members 164, 166 are made of strong and lightweight material, such as aluminum, but alternatively may be made of steel or other material of sufficient strength to support the weight of the remainder of the embodiment 120 and user.

A canvas stool seat 170 is connected to a front cross member 172 of the inner support subassembly 158 and the front wall 128 of the seat member 122. The stool seat 170 is made out of a sturdy material to provide both strength and flexibility.

In the chair configuration, the back support 144 is shown in a first position that is substantially normal to the sitting surface 124. The support assembly 152 is in an expanded state such that the inner subassembly 154 and outer subassembly 156 are angled at approximately a right angle to one another, causing the stool seat 170 to stretch into a substantially planar, vertically-orientated surface.

As shown more specifically in FIG. 14, in the chair configuration, the seat member 124 is supported in a horizontal orientation by positioning a front cross member 174 of the outer subassembly 156 in two forward latches 176 fastened to the bottom of the seat member 122 near the front wall 128. The forward latches 176 partially encircle a portion of the front cross member 174 so that the front cross member can be locked into and removed from the forward latches 174 as desired by the user. A rear cross member 178 of the inner support assembly 154 is fixed in bearings 180 fastened to a bottom section of the seat member 124 proximal to the rear wall 130.

Two load-bearing members 175 each have a bottom surface 177 that is flush with the bottom plane of the seat volume. 131. The load-bearing members 175 are attached to the bottom surface 125 of the top wall 124. The rear wall 130 has a wide bottom portion 179. The load-bearing members 175 in combination with the wide bottom portion 179 help support and distribute the weight of the embodiment 120 and user when the embodiment 120 is placed on a flat surface such as a floor or sidewalk.

Figure 15:
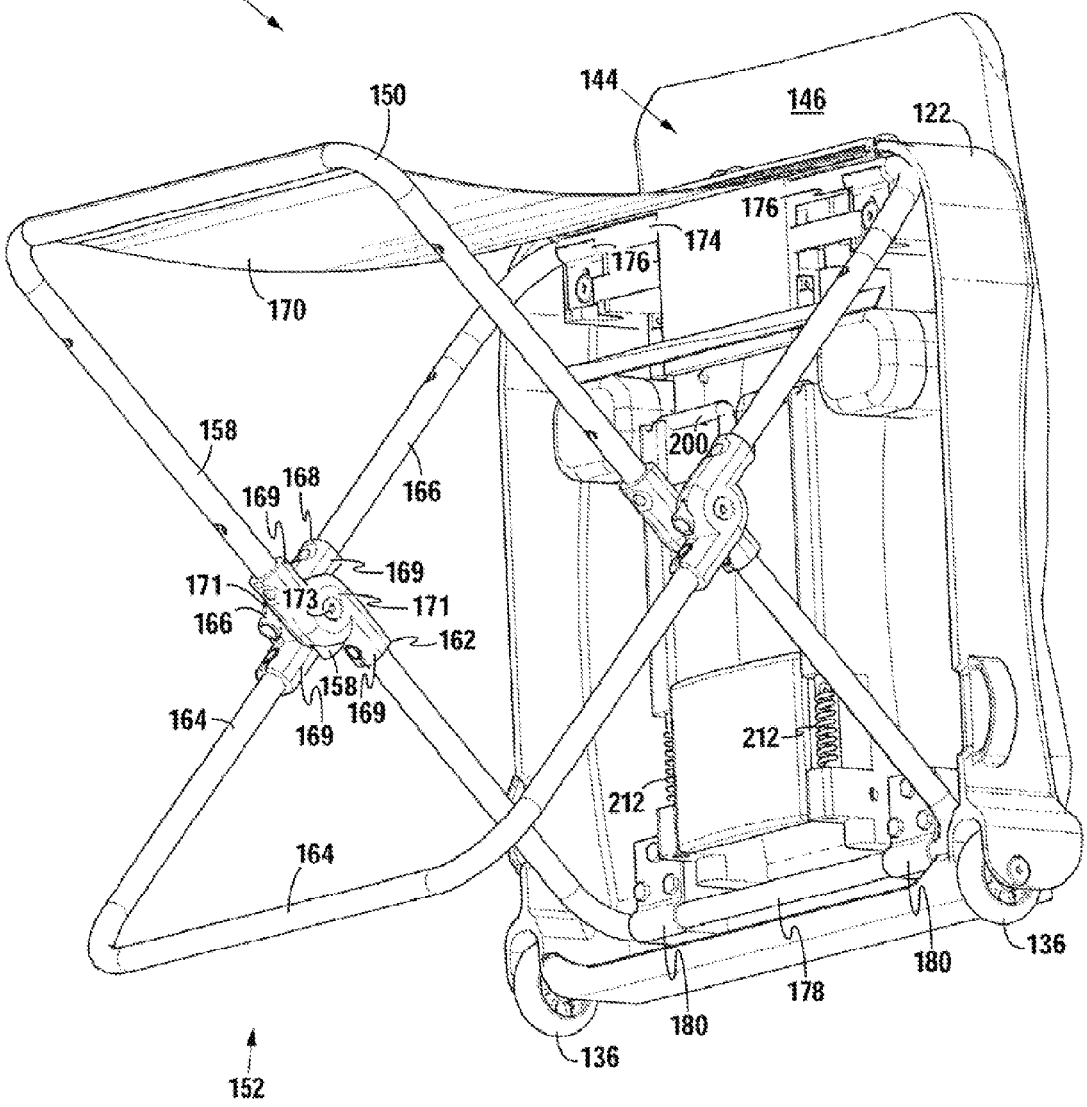
FIG. 15 shows the second embodiment in a stool configuration.

FIG. 15 shows the embodiment 120 in a stool configuration with the back support 144 rotated to a second position adjacent to the seat member 122. The back support 144 may be contoured to the shape of the sitting surface 124 to minimize, or altogether eliminate, space therebetween, thus minimizing the volume occupied by the embodiment 120 in this configuration.

Relative to the orientation of the chair configuration shown in FIGS. 12-14, the embodiment 120 is rotated backward ninety degrees such that the rollers 136 are in contact with the ground surface. The support assembly 152 is in an expanded state, causing the stool seat 170 to be stretched into a sitting surface for supporting a person. The front cross member 174 is positioned in the front latches 176. A rear cross member 178 of the inner support assembly 154 is fixed in bearings 180 fastened to a bottom section of the seat member 124 proximal to the rear wall 130.

Still referring to FIG. 15, the connection between Z-shaped fittings 162, 168 and inner support members 158, 160 and outer support members 164, 166 is shown in greater detail. Each of the Z-shaped fittings 162, 168 has two tubular channel portions 169 into which ends of the respective support members can be slideably inserted. Pins engage the support members though the channel portions 169 and may be manipulated by the user to adjust the position of the inner support members 158, 160 relative to the inner Z-shaped fittings 162 and the position of the outer support members 164, 166 relative to the outer Z-shaped fittings 168. The channel portions of each Z-shaped fitting are misaligned around a center portion 171 so that each support member is slideable with the channel portions 169 without obstruction by the other support members. The center portions 171 of each of the Z-shaped fittings 162, 168 are rotatably fastened with a bolt 173.

Figure 16:
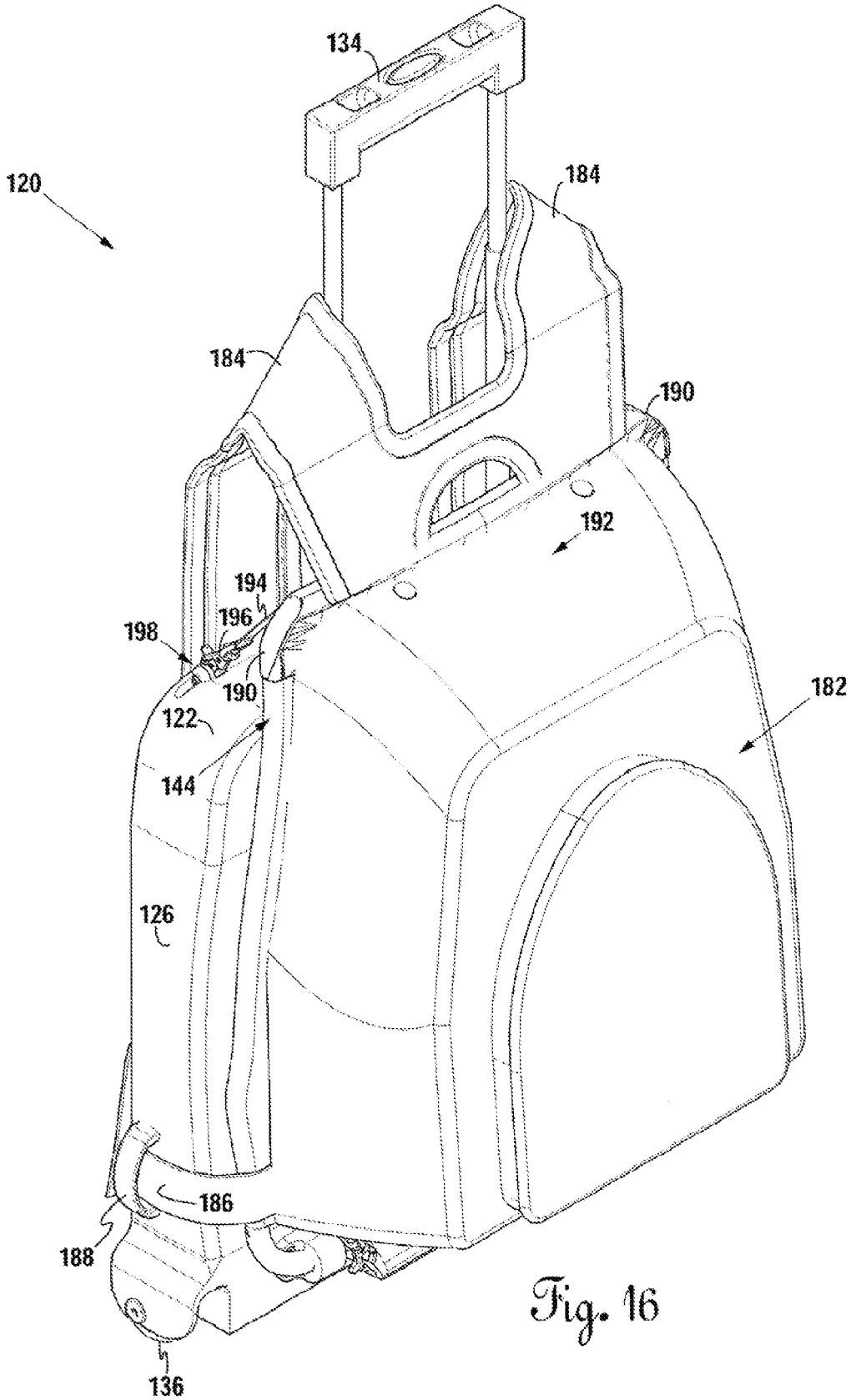
FIG. 16 is a rear isometric view of the second embodiment in a backpack configuration.
Figure 17:
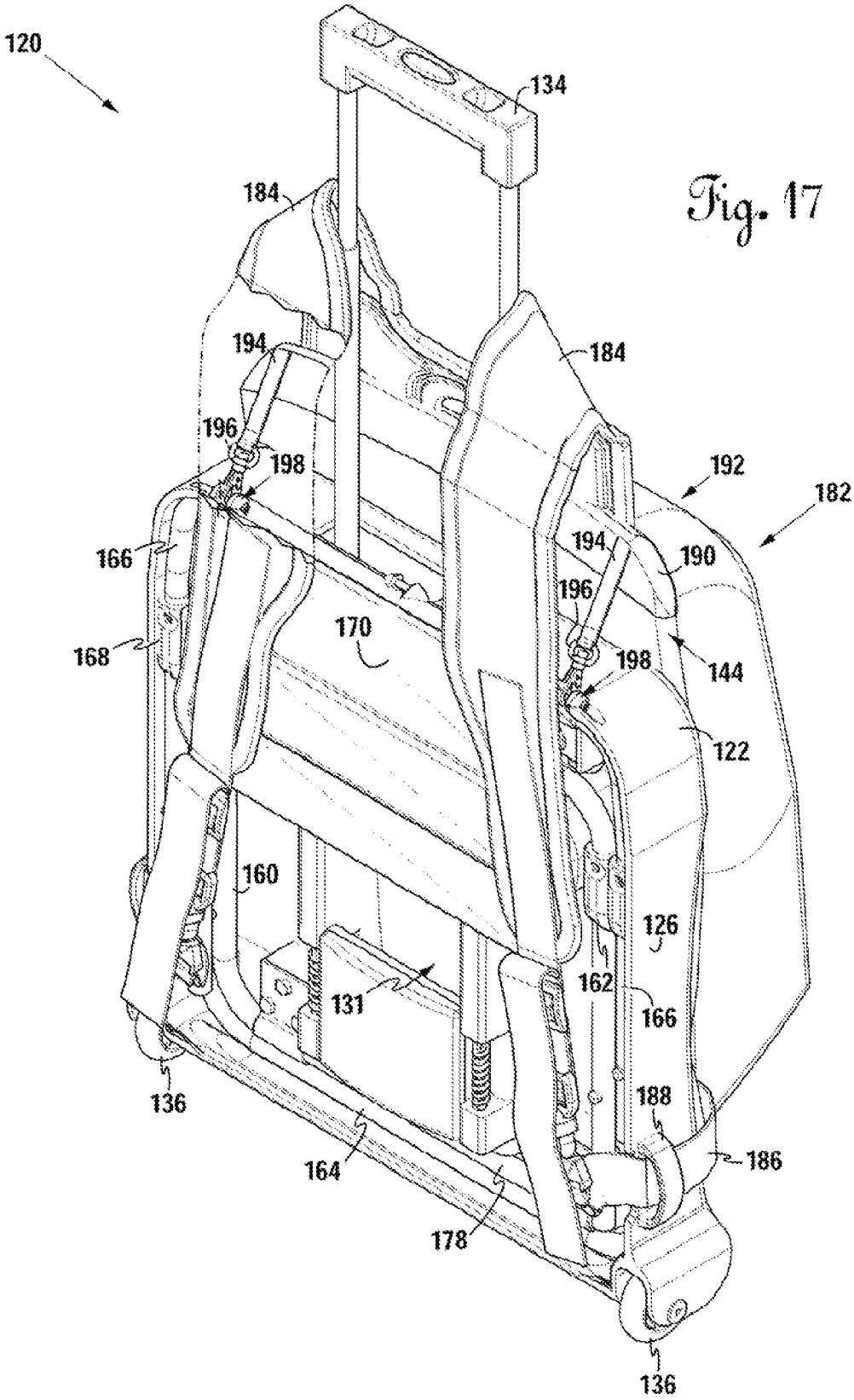
FIG. 17 is a front isometric view of the second embodiment in a backpack configuration.

FIGS. 16-17 show the embodiment 120 in a backpack configuration. An enclosure, such as a backpack 182 comprises two shoulder straps 184 detachably connectable to two waist straps 186. The waist straps 186 are positioned through two rigid loops 188 positioned on the side surfaces 126 of the seat member 122. A sleeve 190 extends across the upper end 192 of the backpack 182 and is positionable over the top end of the back support 144. Two anchoring straps 194 with attached clips 196 extend from the sleeve 190 and are attachable to anchoring points 198 on the front surface 128 of the seat member 122. The sleeve 190 and anchoring straps 194 help prevent the upper end 192 of the backpack 182 from rotating away from the back support 144. When extended, the handle 134 is positioned between the two shoulder straps 184. The rollers 136 may contact a ground surface so that the embodiment 120 can be towed behind the user for ease of transport.

The backpack configuration is attainable from the stool configuration shown in FIG. 15 by folding the support assembly 152 to a folded state and rotating it to a position substantially parallel with the sitting surface 124. To accomplish this, the front cross member 174 of the outer support subassembly 156 must be removed from the front latches 176. The stool seat 170 is positioned against and fastened to the bottom of the seat member 122. The inner support members 158, 160 and outer support members 164, 166 are slideably moved within the Z-shaped fittings 162, 168 to fit within the seat volume 131. The support assembly 152 is then rotated about the rear brackets 180 until completely within the volume 131.

Figure 18:
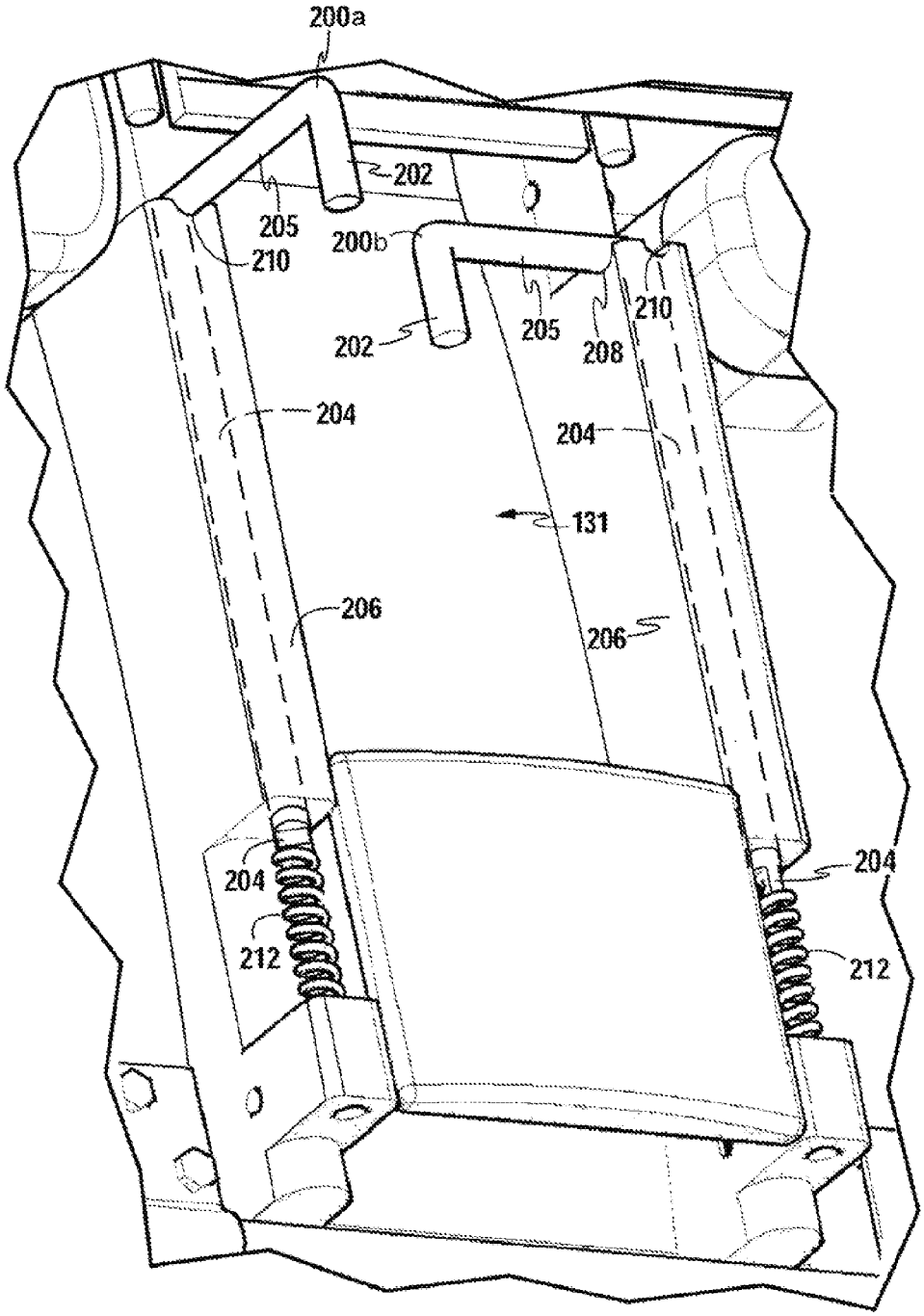
FIG. 18 is bottom isometric view of the seat volume of the second embodiment.

As shown in FIG. 18, two hook members 200*a*, 200*b* are contained within the volume 131 defined by the seat member 122. Each hook member 200 has a hook portion 202, and a shaft portion 204. Each of the hook portions 202 include a cross member 205 connected to the shaft portion 204. The hook members 200 are rotatable between a first position wherein the hook portions 202 are horizontally orientated and entirely within the volume 131 of the seat member 122, which is the position of one hook member 200*b*, and a second position wherein the hook portions 202 extend outside the volume of the seat member 122, which is the position of the other hook member 200*a*. The shaft portion 204 is positioned within a notched housing 206 having lateral notches 208 and bottom notches 210, and connected to a coil spring 212 in an expanded state. The coil springs 212 exert a pulling force on the connected shafts 204 to hold the hook member 200 in either the lateral notch 208 or the bottom notch 210 formed in the front end of the housing. The user may pull the hook members 200 forward to overcome the contracting force of the spring 212 and rotate the hook member 200 to the second position. When released, the coil spring 212 will pull the hook member 200 against the notch to inhibit unintentional rotation of the hook member 200 to the other position.

Figure 19:
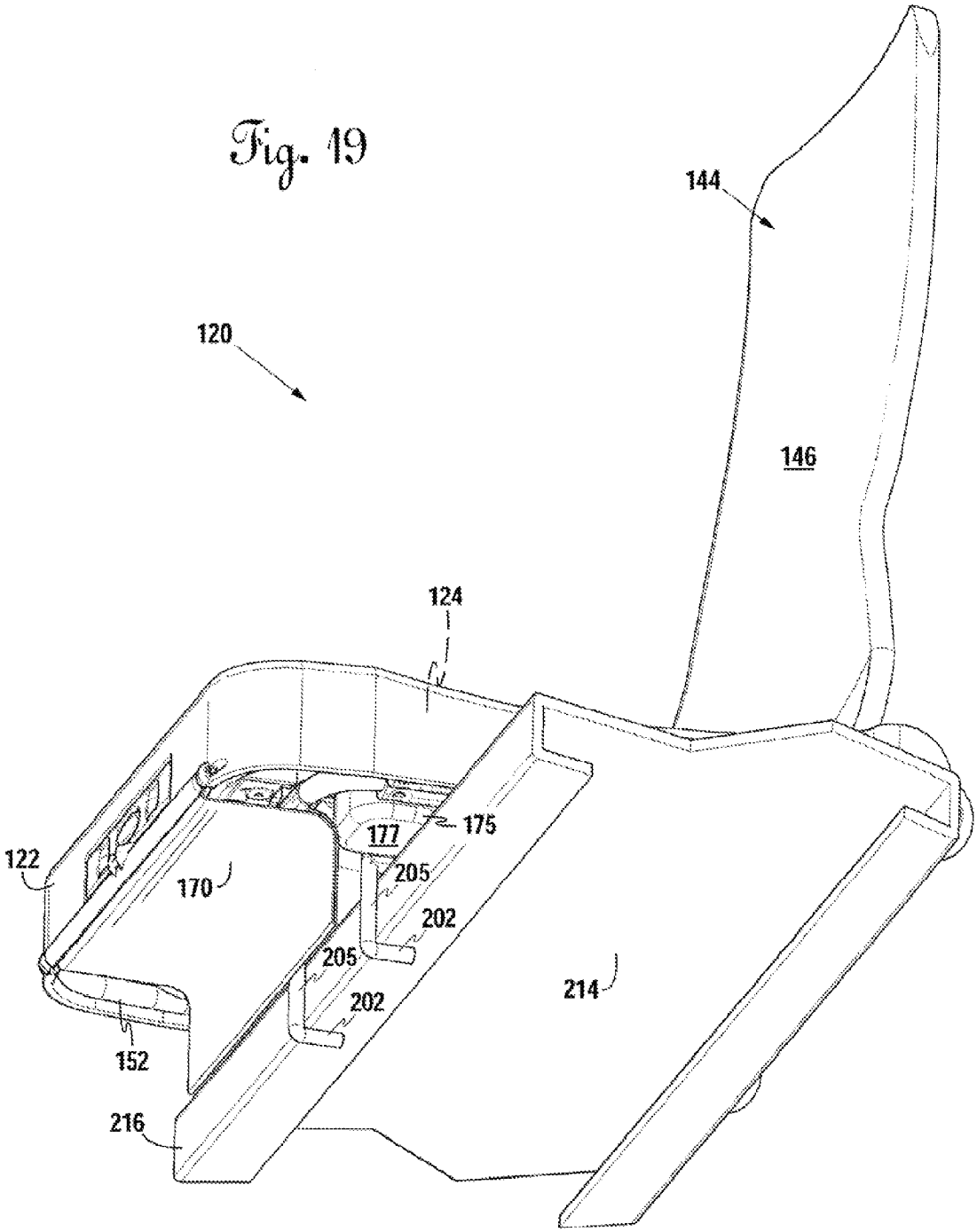
FIG. 19 is a bottom isometric view of the second embodiment in a bleacher seat configuration engaged with a bleacher seat.

As shown in FIG. 19, the embodiment 120 may thereafter be positioned on a bleacher seat 214 with hook portions 202 engaging with a front surface 216. The vertically orientated cross members 205 prevent inadvertent backward movement of the embodiment relative to the bleacher seat 200 when, for example, the user sits down in the embodiment 120 and causes a rearward force. Similarly, the hook portions 202 prevent inadvertent upward movement of the embodiment 120 relative to the seat due to engagement of the hook members 200 with the bottom surface of the bleacher seat 214. The support assembly 152 is in a folded state and rotated to a position substantially parallel to and wholly within the volume 131 defined by the seat member 122. The stool seat 170 is folded and positioned below the seat member 122. The back support 144 is in substantially the same position as shown in FIG. 12—that is, substantially normal relative to the sitting surface 124 of the seat member 122.

Still referring to FIG. 19, by moving the hook members 200 to the first hook position, the hook members 200 and foldable support assembly 152 are entirely positioned within the seat volume 131. The embodiment 120 can then be positioned on any flat surface, such as a floor or sidewalk, to view a parade or other entertainment. When so positioned, the bottom surfaces 177 of the load-bearing members 175 and the wide bottom portion 179 (see FIG. 14) of the rear wall help distribute the weight of the embodiment 120 and the user. In this configuration, the embodiment 120 provides both back support and seat cushioning, allowing the user comfortable seat at floor level without restricting visibility to other views. This may be particularly beneficial when in queue waiting for shows or rides, such as at a theme park.

The present invention is described above in terms of preferred illustrative embodiments of a specifically described combination backpack and seating apparatus. Those skilled in the art will recognize that alternative constructions and implementations of such an apparatus can be used in carrying out the present invention. Other aspects, features, and advantages of the present invention may be obtained from a study of this disclosure and the drawings, along with the appended claims.

I claim:

1. A seating apparatus configurable to a chair configuration, a stool configuration, a backpack configuration, a legless chair configuration, and a bleacher seat configuration, the seating apparatus comprising:

a rigid seat member having a top wall, at least one side wall, a front wall, and a rear wall, said top wall, at least one side wall, front wall, and rear wall defining an open seat volume;

a back support rotatably connected to said seat member proximal to the intersection of said top wall and said rear wall, wherein said back support is rotatable between an first back support position that is at least substantially normal to said top wall and a second back support position at least substantially parallel to said sitting surface;

a foldable support assembly configurable to a generally planar folded state and an expanded state, wherein in said folded state said support assembly is rotatable to a first support position at least substantially parallel to said top wall;

an enclosure having a volume, said enclosure being securable to said back support; and wherein said foldable support assembly comprises:

an inner support subassembly pivotably connected to an outer support assembly, wherein said inner support assembly comprises:

two inner Z-shaped fittings, each of said inner Z-shaped fittings having two tubular channel portions longitudinally misaligned and extending from a center portion;

two generally U-shaped inner support members slideably engaged with said tubular channel portions of said inner Z-shaped fittings;

wherein said outer support assembly comprises:

two outer Z-shaped fittings, each of said outer Z-shaped fittings having two tubular channel portions longitudinally misaligned and extending from a center portion; and two generally U-shaped outer support members slideably engaged with said two tubular channel portions of said outer Z-shaped fittings; and wherein said center portions of said outer Z-shaped fittings are in rotatable connection with said center portions of said inner Z-shaped fittings.

2. The apparatus of claim 1 wherein said foldable support assembly is further rotatable to a second support position that is substantially parallel to said back support when said back support is in said first back support position.

3. The apparatus of claim 1 further comprising a stool seat attachable to said support assembly that forms a generally planar sitting surface when said support assembly is in said expanded state.

4. The apparatus of claim 1 said further comprising a handle extendable between a first handle position and a second handle position.

5. The apparatus of claim 4 wherein in said first handle position said handle assembly is substantially within the volume defined by said enclosure and in said second handle position said handle is substantially outside said enclosure volume.

6. The apparatus of claim 4 wherein in said first handle position said handle assembly is contained within the seat volume and in said second handle position said handle assembly is extended from said seat volume through said front wall of said seat member.

7. The apparatus of claim 1 wherein said seat assembly further comprises at least one roller rotatably fastened to and extending at least partially rearward of said rear wall of said seat member.

8. The apparatus of claim 7 wherein said at least one roller is rotatably fastened to said seat member within channels formed at the corners of said rear wall.

9. The apparatus of claim 1 further comprising carrying straps connected to said seat member.

10. The apparatus of claim 1 wherein said enclosure is a backpack having a sleeve positionable around the top of said back support, said backpack further having straps selectively attachable to anchoring points located on said seat member.

11. The apparatus of claim 1 further comprising at least one block bearing positioned proximal to an intersection of said top wall and said rear wall, and wherein said back support comprises a frame positioned and rotatable within said at least one block bearing to said first support position.

12. The apparatus of claim 1 further comprising at least one hook member rotatably connected to said seat member, said at least one hook member being rotatable between a first hook position and a second hook position, wherein in said first hook position said at least one hook member is within said seat volume, and wherein in said second hook position said at least one hook member extends at least partially outside said seat volume.

13. The apparatus of claim 12 further comprising wherein said at least one hook member comprises a shaft portion and a hook portion, wherein in said second hook position said hook portion are orientated rearward, and further comprising a spring biasing said at least one hook member rearward.

14. The apparatus of claim 1 wherein said front surface of said back support is contoured to correspond to the contour of said top wall.

15. The apparatus of claim 1 further comprising:

at least one tab fixed to a front surface of said enclosure; and at least one cleft formed in the rear surface of said back support corresponding to and shaped and sized to receive said at least one tab.

16. The apparatus of claim 1 wherein said inner support member is rotatable between a first inner support position and a second inner support position, said first inner support position being substantially below and angled relative to said seat member; and said second inner support position being substantially above said seat member and proximal to said back member.

17. The apparatus of claim 1 wherein in said second support position said support assembly is at least substantially within said seat volume.

* * * * *